US009407045B2

(12) United States Patent
Horning et al.

(10) Patent No.: US 9,407,045 B2
(45) Date of Patent: Aug. 2, 2016

(54) ELECTRICAL CONNECTOR WITH JOINED GROUND SHIELDS

(71) Applicant: Tyco Electronics Corporation, Berwyn, PA (US)

(72) Inventors: Michael James Horning, Lancaster, PA (US); Wayne Samuel Davis, Harrisburg, PA (US); Chad W. Morgan, Carneys Point, NJ (US); Vincent Ruminski, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/571,497

(22) Filed: Dec. 16, 2014

(65) Prior Publication Data

US 2016/0172792 A1 Jun. 16, 2016

(51) Int. Cl.
*H01R 13/648* (2006.01)
*H01R 13/6587* (2011.01)

(52) U.S. Cl.
CPC ..... *H01R 13/6587* (2013.01)

(58) Field of Classification Search
CPC ..... H01R 13/65802
USPC ..... 439/607.1, 607.5, 607.11, 607.09
See application file for complete search history.

(56) References Cited

U.S. PATENT DOCUMENTS

| | | | | |
|---|---|---|---|---|
| 5,620,340 | A * | 4/1997 | Andrews | H01R 23/688 439/108 |
| 6,506,076 | B2 * | 1/2003 | Cohen | H01R 23/688 439/607.09 |
| 6,520,803 | B1 | 2/2003 | Dunn | |
| 6,527,587 | B1 * | 3/2003 | Ortega | H01R 23/688 439/607.05 |
| 8,480,413 | B2 | 7/2013 | Minich et al. | |
| 2002/0022401 | A1 * | 2/2002 | Ramey | H01R 13/65807 439/607.1 |

* cited by examiner

*Primary Examiner* — Phuong Dinh

(57) ABSTRACT

An electrical connector includes a housing, signal contacts, and ground shields. The housing extends between a front end and a rear end and defines a cavity at the front end. The signal contacts are held by the housing and are arranged in pairs carrying differential signals. The signal contacts have mating ends in the cavity for mating with a mating connector. The ground shields are held by the housing and extend along the signal contacts in the cavity. The ground shields have center walls and side walls surrounding associated pairs of the signal contacts on at least two sides thereof. The ground shields each have a commoning feature extending outward from a corresponding side wall. The commoning feature mechanically engages another ground shield in a group of ground shields to electrically join the ground shields of the group within the cavity.

20 Claims, 7 Drawing Sheets

ELECTRICAL CONNECTOR WITH JOINED GROUND SHIELDS

BACKGROUND OF THE INVENTION

The subject matter herein relates generally to electrical connectors that have ground shields and signal contacts.

Some known electrical connectors are mezzanine connectors that mechanically and electrically interconnect a pair of circuit boards in a parallel arrangement. In some connector arrangements, a single mezzanine connector will engage both circuit boards to interconnect the circuit boards. For example, the mezzanine connector will be mounted to one of the circuit boards and will engage the other circuit board at a separable mating interface. At least some known mezzanine connector systems utilize two mezzanine connectors, each mounted to a different circuit board and then mated together. Such systems can be complex and difficult to manufacture. For example, such mezzanine connectors have many contacts individually loaded into a housing, which may be difficult and time consuming to assemble. Furthermore, the contacts may be deflectable spring beams that require long beam lengths to achieve the required spring force and deformation range at the mating interface between the two connectors. The mezzanine connectors have ground shields that are designed to shield individual contacts or contact pairs along the beam length. But, known mezzanine connectors suffer from signal performance limits because the ground shields are not electrically commoned with each other along the length of the connectors. For example, the ground shields may be electrically commoned at the circuit boards, but a lack of commoning along the beam lengths and at the mating interface results in electrical interference that is detrimental to the signal integrity of the mezzanine connectors.

Thus, a need exists for an electrical connector having an array of signal contacts and enhanced ground shielding that improves electrical performance.

BRIEF DESCRIPTION OF THE INVENTION

In one embodiment, an electrical connector is provided that includes a housing, signal contacts, and ground shields. The housing extends between a front end and an opposite, rear end. The housing defines a cavity at the front end. The signal contacts are held by the housing. The signal contacts are arranged in pairs carrying differential signals. The signal contacts have mating ends in the cavity for mating with a mating connector. The ground shields are held by the housing. The ground shields extend along the signal contacts in the cavity. The ground shields have center walls and side walls surrounding associated pairs of the signal contacts on at least two sides thereof.

The ground shields each have a commoning feature extending outward from a corresponding side wall. The commoning feature mechanically engages another ground shield in a group of ground shields to electrically join the ground shields of the group within the cavity.

In another embodiment, an electrical connector is provided that includes a housing, signal contacts, and ground shields. The housing extends between a front end and an opposite, rear end. The housing defines a cavity at the front end. The signal contacts are held by the housing. The signal contacts have mating ends in the cavity for mating with a mating connector. The ground shields are held by the housing. The ground shields extend along the signal contacts in the cavity and are arranged in an array of rows and columns. The ground shields each have one center wall and two side walls. The side walls extend from opposing ends of the center wall. At least one of the side walls of each ground shield has a commoning feature extending outward from the respective side wall. The commoning feature of a first ground shield of the ground shields mechanically engages a second ground shield of the ground shields such that the first and second ground shields are electrically joined with each other. The first and second ground shields are within a first row of the rows.

DETAILED DESCRIPTION OF THE INVENTION

Figure 1:
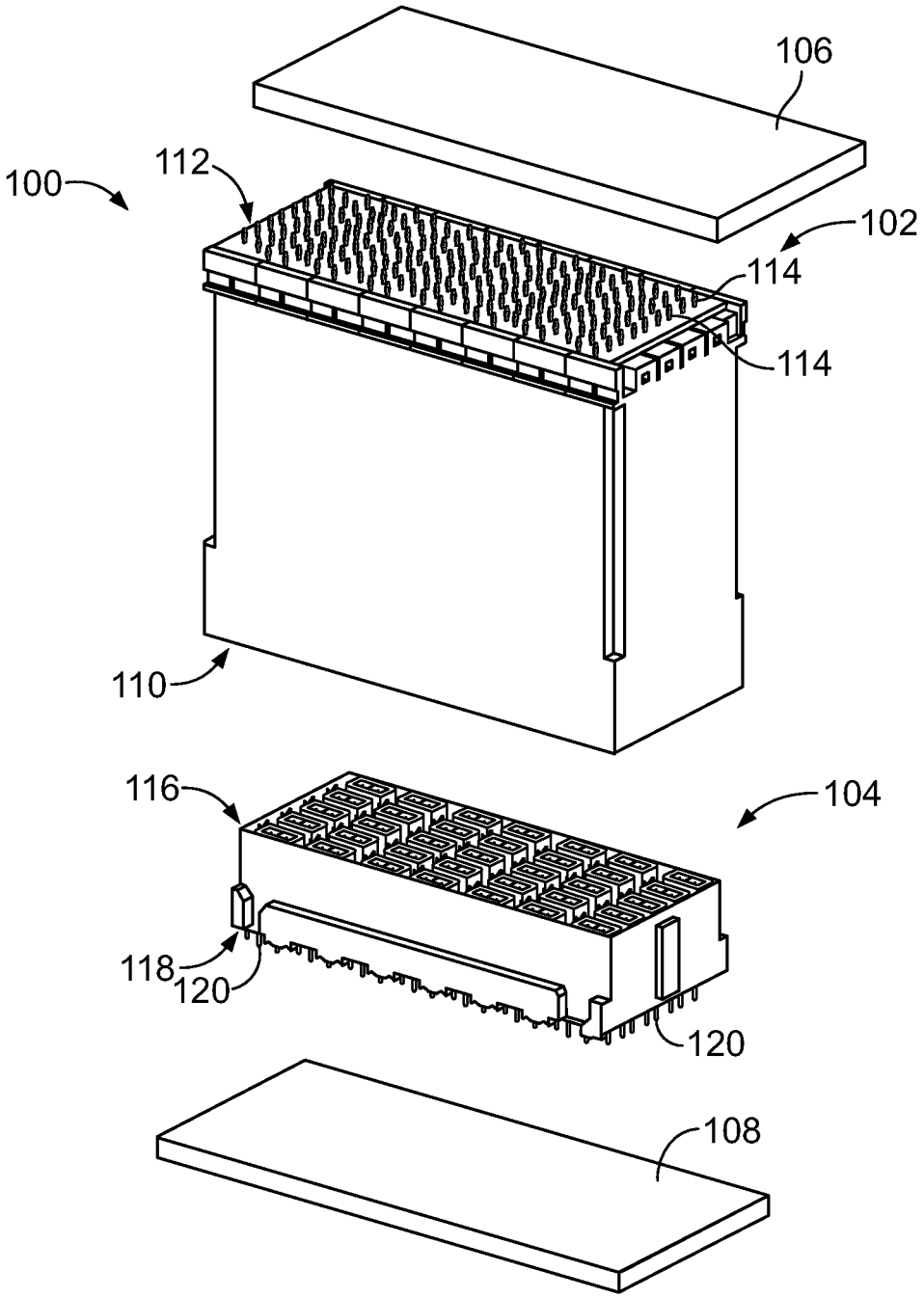
FIG. 1 illustrates an electrical assembly formed in accordance with an embodiment.

FIG. 1 illustrates a connector assembly 100 formed in accordance with an embodiment. The connector assembly 100 includes a first electrical connector 102 and a second electrical connector 104 that are mated together to electrically connect first and second circuit boards 106, 108. The first electrical connector 102 and the second electrical connector 104 are arranged to interconnect the first and second circuit boards 106, 108. The first connector 102 and the second connector 104 may be mezzanine connectors that connect the circuit boards 106, 108 in a parallel arrangement. However, it is realized that the subject matter herein may be used in other types of electrical connectors as well, such as right angle connectors, cable connectors (being terminated to an end of one of more cables), or other types of electrical connectors. In an embodiment, the first electrical connector 102 is a header connector 102 and the second electrical connector 104 is a receptacle connector 104. The terms "header connector 102" and "receptacle connector 104" are used herein to identify the first electrical connector 102 and the second electrical connector 104, respectively. The header connector 102 and the receptacle connector 104 may also be referred to herein as "mezzanine header connector 102" and "mezzanine receptacle connector 104," respectively.

The circuit boards 106, 108 are interconnected by the header and receptacle connectors 102, 104 so that the circuit boards 106, 108 are substantially parallel to one another. The first and second circuit boards 106, 108 include conductors that communicate data signals and/or electric power between the header and receptacle connectors 102, 104 and one or more electrical components (not shown) that are electrically connected to the circuit boards 106, 108. The conductors may be embodied in conductive pads or traces deposited on one or more layers of the circuit boards 106, 108, in plated vias, or in other conductive pathways, contacts, and the like.

The header connector 102 includes a mating interface 110 and a mounting interface 112. The mating interface 110 is configured to mate with the receptacle connector 104. The mounting interface 112 is configured to mount to the first circuit board 106. For example, the header connector 102 includes plural conductive tails 114 that extend along the mounting interface 112 and are configured to be electrically terminated to the conductors on the circuit board 106. The conductive tails 114 may be compliant pins configured to be received in plated vias of the circuit board 106. Although the mating interface 110 is shown as being on an opposite end of the header connector 102 relative to the mounting interface 112, in other embodiments the mating interface 110 may be adjacent to the mounting interface 112, such as for a right angle connector. The receptacle connector 104 also includes a mating interface 116 that mates to the header connector 102 and a mounting interface 118 that mounts to the second circuit board 108. The receptacle connector 104 includes conductive tails 120 extending from the mounting interface 118 that are configured to electrically terminate to the conductors on the circuit board 108.

Figure 2:
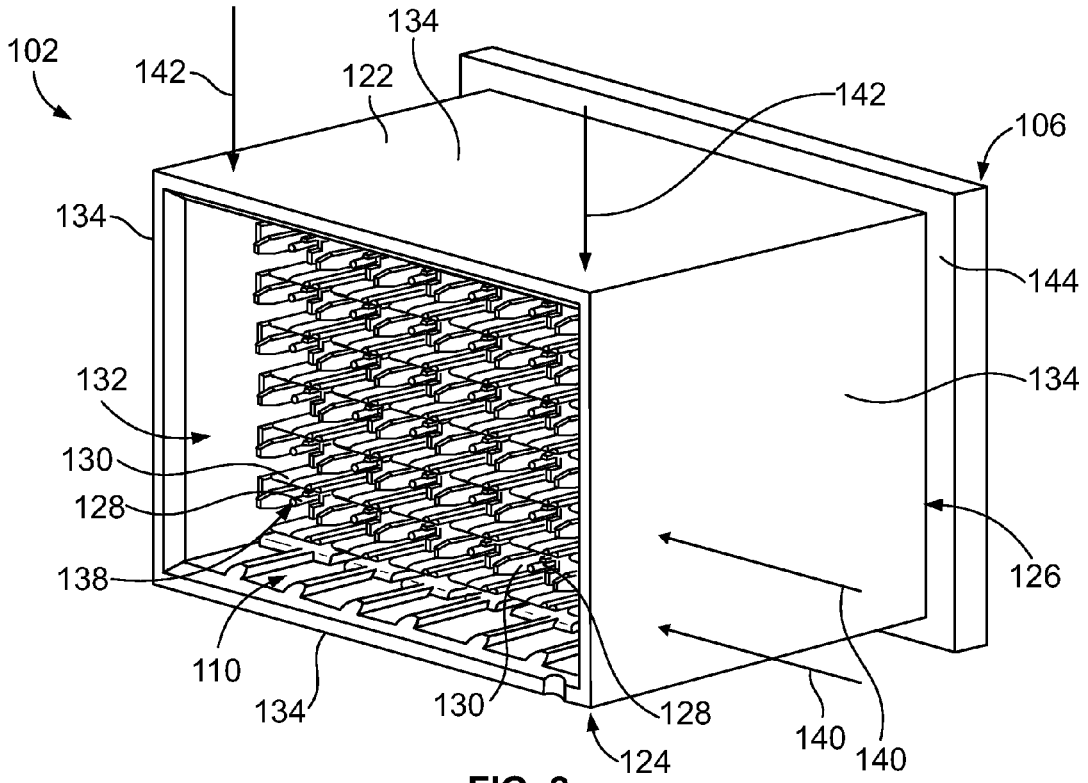
FIG. 2 is a perspective view of a header connector of the electrical assembly in accordance with an embodiment.

FIG. 2 is a perspective view of the mezzanine header connector 102 in accordance with an embodiment. The mezzanine header connector 102 includes a housing 122 that holds signal contacts 128 and ground shields 130. The housing 122 extends between a front end 124 and an opposite, rear end 126. As used herein, relative or spatial terms such as "top," "bottom," "left," "right," "front," and "rear" are only used to distinguish the referenced elements and do not necessarily require particular positions or orientations in the mezzanine connector assembly 100 (shown in FIG. 1), in the mezzanine header connector 102 specifically, or in the surrounding environment. The front end 124 includes the mating interface 110. The housing 122 defines a cavity 132 at the front end 124. The cavity 132 is configured to receive at least a portion of the mating interface 116 (shown in FIG. 1) of the receptacle connector 104 (FIG. 1) when the connectors 102, 104 are mated. The housing 122 includes sides 134 that define a perimeter of the housing 122 between the front end 124 and the rear end 126. Optionally, the housing 122 may be generally box shaped, although the housing 122 may have other shapes in alternative embodiments. The housing 122 is formed of a dielectric material, such as a plastic.

The signal contacts 128 are held by the housing 122 and extend into the cavity 132 from a rear wall 136 (shown in FIG. 3) of the housing 122. For example, the signal contacts 128 have mating ends 138 in the cavity 132. The signal contacts 128 are conductive and are configured to mechanically engage corresponding receptacle contacts (not shown) of the mezzanine receptacle connector 104 (shown in FIG. 1). Optionally, the signal contacts 128 are arranged in pairs carrying differential signals. In the illustrated embodiment, the mating ends 138 of the signal contacts 128 are arranged in an array of rows 140 and columns 142 within the cavity 132 of the housing 122. The rows 140 and columns 142 are both parallel to a mounting surface 144 of the first circuit board 106. In the illustrated embodiment, the rows 140 are oriented horizontally and the columns 142 are oriented vertically.

The ground shields 130 are held by the housing 122 and extend along the signal contacts 128 within the cavity 132. For example, each ground shield 130 may peripherally surround an associated signal contact 128 or pair of signal contacts 128 on at least two sides thereof along a length between the rear wall 136 (shown in FIG. 3) and the mating end 138 of the associated signal contact(s) 128. The ground shields 130 are conductive and provide electrical shielding between the associated signal contact(s) 128 and other signal contacts 128 in the cavity 132. The ground shields 130 are arranged in the rows 140 and columns 142 of the signal contacts 128. As will be described below, at least some of the ground shields 130 are electrically joined or commoned with each other within the cavity 132 of the housing 122. As used herein, "electrically join" and "electrically common" are used synonymously to mean connection via a continuous conductive electrical pathway. Electrically commoning at least some of the ground shields 130 within the housing 122 may improve electrical performance of the connector assembly 100 (shown in FIG. 1) by canceling and/or reducing signal noise (for example, cross-talk), improving inter-pair signal skew, providing a pre-determined impedance, raising resonant frequencies to a range outside of operating frequency levels, and/or the like. The ground shields 130 may be electrically joined via mechanical engagement of the ground shields 130 so as to provide a continuous electrical pathway from any one ground shield 130 of a group of connected ground shields 130 to all other ground shields 130 in the group. The group of connected ground shields 130 may include multiple ground shields 130 in the same row 140, multiple ground shields 130 in the same column 142, or both.

Figure 3:
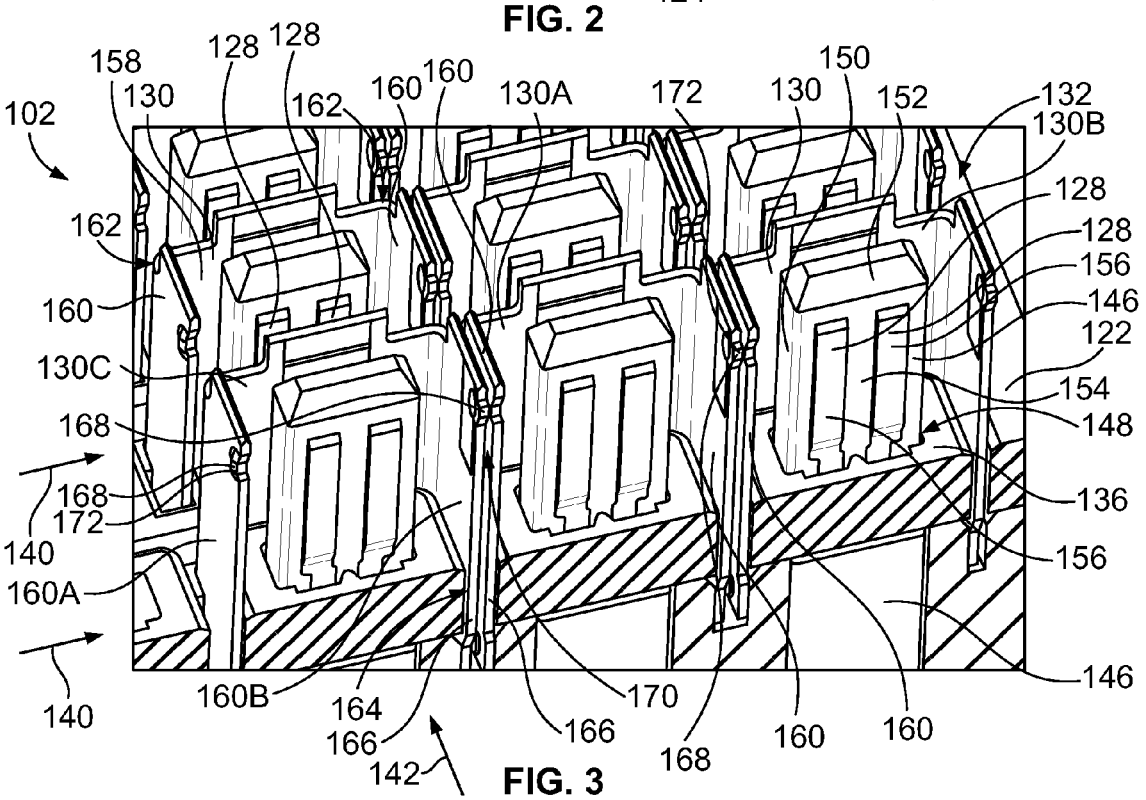
FIG. 3 is a cross-section of a portion of the header connector according to an embodiment.

FIG. 3 is a cross-section of a portion of the mezzanine header connector 102 according to an embodiment. The cross-section extends through the rear wall 136 of the housing 122. In the illustrated embodiment, the signal contacts 128 are arranged in pairs that carry differential signals. In alternative embodiments, the signal contacts 128 may carry single-ended signals rather than differential signals. In other alternative embodiments, the signal contacts 128 may carry power rather than data signals. The signal contacts 128 in the illustrated embodiment are held on dielectric rails 146. Optionally, the rails 146 may each be part of a single dielectric holder that is overmolded over and/or around a leadframe that includes the signal contacts 128. In alternative embodiments, the signal contacts 128 may be coupled to the rails 146 by methods other than overmolding, such as via fasteners and/or adhesives.

The rails 146, with the signal contacts 128 thereon, extend through openings 148 in the rear wall 136. Optionally, the rails 146 may be loaded into the cavity 132 through the openings 148 from behind the rear wall 136 of the housing 122. The rails 146 extend along generally linear paths. The rails 146 define front support beams 150 that are cantilevered forward of the rear wall 136 in the cavity 132. The front support beams 150 support portions of the signal contacts 128. The front support beams 150 have ramped lead-ins 152 that lead to the signal contacts 128. The lead-ins 152 prevent stubbing when the header connector 102 is mated with the mezzanine receptacle connector 104 (shown in FIG. 1). In an embodiment, the signal contacts 128 are exposed along an outer side 154 of each corresponding rail 146. For example, the dielectric rail 146 is overmolded around the signal contacts 128 such that side surfaces 156 of the signal contacts 128 are flush with and exposed at the outer side 154. In the illustrated embodiment, the two signal contacts 128 of each pair are arranged side-by-side along the same outer side 154 of the corresponding rail 146. In an alternative embodiment, one signal contact 128 is disposed along the outer side 154, and the other signal contact 128 of the pair is disposed along an opposite outer side (not shown) of the rail 146.

Each of the ground shields 130 peripherally surrounds an associated pair of the signal contacts 128 in the illustrated embodiment. For example, the ground shields 130 have center walls 158 and side walls 160 that surround the pairs of signal contacts 128 on at least two sides. In the illustrated embodiment, each of the ground shields 130 is C-shaped, covering three sides of the associated pair of signal contacts 128. The ground shields 130 each include one center wall 158 and two side walls 160. The two side walls 160 extend from opposite ends 162 of the center wall 158.

Optionally, the side walls 160 may extend parallel to each other and perpendicular to the center wall 158. Since the ground shield 130 is C-shaped, one side of the ground shield 130 is open. In the illustrated embodiment, each of the ground shields 130 has an open bottom, and an adjacent ground shield 130 below the open bottom provides shielding across the open bottom. For example, the adjacent ground shield 130 that provides shielding across the open bottom may be in the same column 142 but a different row 140 from the associated ground shield 130. Each pair of signal contacts 128 is therefore surrounded on all four sides thereof by the associated C-shaped ground shield 130 and the adjacent ground shield 130 below the pair of signal contacts 128. As such, the ground shields 130 cooperate to provide circumferential electrical shielding for each pair of signal contacts 128. The ground shields 130 electrically shield each pair of signal contacts 128 from every other pair of signal contacts 128. For example, the ground shields 130 may span all direct line paths from any one pair of the signal contacts 128 to any other pair of the signal contacts 128 to provide electrical shielding across all of the direct line paths.

In alternative embodiments, other types of ground shields 130 may be provided. For example, L-shaped ground shields may be used that provide shielding on two sides of the associated pair of signal contacts 128. Cooperation with other ground shields 130 provides electrical shielding on all sides (for example, above, below, and on both sides of the pair). In some other embodiments, the ground shields 130 may be associated with individual signal contacts 128 as opposed to pairs of signal contacts 128.

The ground shields 130 are loaded into the cavity 132 from the front end 124 (shown in FIG. 2) of the housing 122. The housing 122 defines slots 164 in the rear wall 136 that receive rear portions 166 of the ground shields 130. Optionally, some of the slots 164 are sized to accommodate one side wall 160 from each of two adjacent ground shields 130 in the same row 140. The ground shields 130 are held in the slots 164 by an interference fit. The ground shields 130 may be loaded into the cavity 132 one at a time.

In an exemplary embodiment, the ground shields 130 have at least one commoning feature 168 extending outward from a corresponding side wall 160. Each commoning feature 168 mechanically engages another ground shield 130 in a same group of ground shields 130 to electrically join or common the ground shields 130 of the group. The commoning feature 168 engages the other ground shield 130 in the cavity 132 of the housing 122. As a result, the ground shields 130 of the group are electrically commoned proximate to the separable mating interface between the header connector 102 and the receptacle connector 104 (shown in FIG. 1).

In an embodiment, the commoning feature 168 extends from the corresponding side wall 160 of a first ground shield 130A and engages, directly or indirectly, one of the side walls 160 of a second ground shield 130B. The commoning feature 168 engages the side wall 160 of the second ground shield 130B directly when the commoning feature 168 physically contacts a planar surface of the side wall 160. The commoning feature 168 engages the side wall 160 of the second ground shield 130B indirectly when the commoning feature 168 physically contacts a component on or extending from the side wall 160, such as another commoning feature 168. The first and second ground shields 130A, 130B that engage each other are in the same row 140 within the cavity 132. For example, the commoning feature 168 of the first ground shield 130A extends at least partially across a gap 170 between adjacent ground shields 130 in the same row 140 to engage the side wall 160 of the second shield 130B. Thus, the group of ground shields 130 that are electrically commoned may be the ground shields 130 in each row 140. For example, the commoning feature 168 of the first ground shield 130A mechanically engages the second ground shield 130B, which is adjacent to the first ground shield 130A on one side of the first ground shield 130A. Furthermore, a different side wall 160 of the first ground shield 130A may be mechanically engaged by the commoning feature 168 of a third ground shield 130C that is adjacent to the first ground shield 130A on a second side of the first ground shield 130A. As such, the first ground shield 130A is disposed between the third ground shield 130C and the second ground shield 130B in the same row 140, and all three ground shields 130A-130C are electrically commoned via the commoning features 168.

In an embodiment, the side walls 160 of each ground shield 130 include a left side wall 160A and a right side wall 160B. One or both of the left and right side walls 160A, 160B may include the commoning feature 168 thereon. The commoning feature 168 on the right side wall 160B is configured to mechanically engage the left side wall 160A (or a commoning feature 168 on the left side wall 160A) of an adjacent ground shield 130 in the row 140 to the right. Conversely, the commoning feature 168 on the left side wall 160A is configured to mechanically engage the right side wall 160B (or a commoning feature 168 on the right side wall 160B) of an adjacent ground shield 130 in the row 140 to the left.

In the illustrated embodiment, the commoning feature 168 is a convexity 172 that protrudes outwards from the corresponding side wall 160. For example, the convexity 172 may be a bulge, a boss, or a protuberance that extends out of plane of the corresponding side wall 160. The convexity 172 may deflect at least partially inwards (for example, towards an interior of the ground shield 130) upon mechanically engaging the adjacent ground shield 130 in the group. The convexity 172 applies a biasing force on the adjacent ground shield 130 to retain mechanical engagement therewith. In the illustrated embodiment, the ground shields 130 include one commoning feature 168 on each of the side walls 160A, 160B. In addition, the commoning feature 168 on both side walls 160A, 160B optionally is an identical convexity 172. For example, the convexity 172 on the right side wall 160B engages the ground shield 130 to the right within the row 140, and the convexity 172 on the left side wall 160A engages the ground shield 130 to the left within the row 140. As a result, the convexity 172 on the right side wall 160B engages a different ground shield in the group than the convexity 172 on the left side wall 60A. Optionally, the convexities 172 are all disposed a same distance from the rear wall 136, and the convexity 172 on the right side wall 160B of the first ground shield 130A engages the convexity 172 on the left side wall 160A of the adjacent second ground shield 130B. Thus, the contacting convexities 172 each extend half of the full width of the gap 170 separating the ground shields 130A, 130B and engage each other in the gap 170.

In alternative embodiments, the commoning features 168 on the left side walls 160A may be different than the commoning features 168 on the right side walls 160B. The commoning features 168 in one or more alternative embodiments are disposed on only one of the side walls 160 of each ground shield 130 instead of on both. Furthermore, the commoning features 168 in other embodiments have shapes and orientations different from the convexities 172, as shown and described in the embodiments below.

Figure 4:
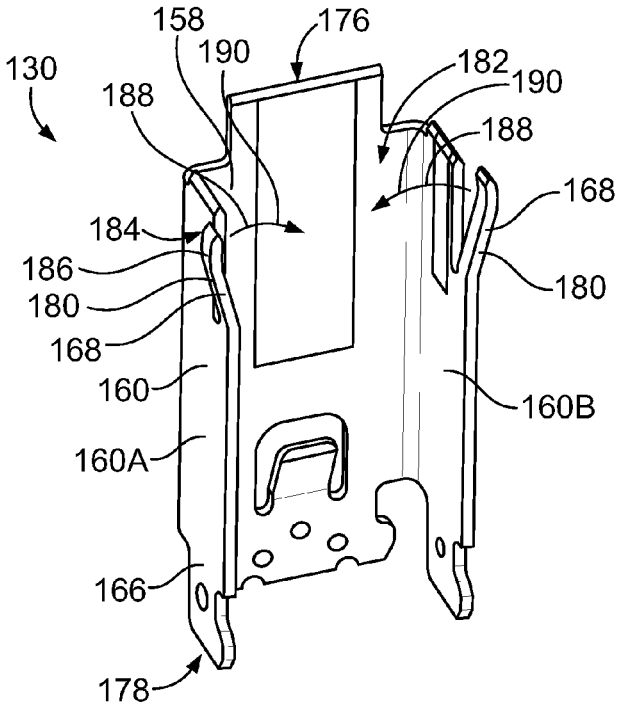
FIG. 4 is a perspective view of a ground shield of the header connector according to another embodiment.

FIG. 4 is a perspective view of a ground shield 130 of the mezzanine header connector 102 (shown in FIG. 1) according to another embodiment.

Figure 5:
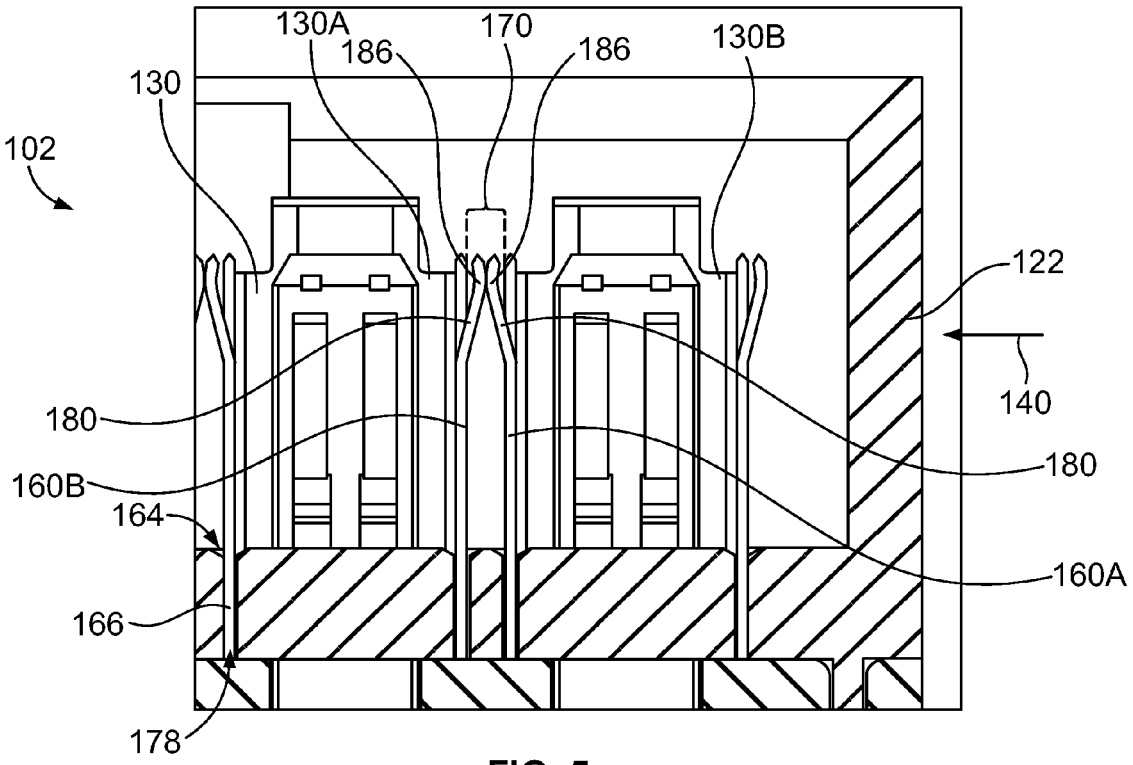
FIG. 5 is a cross-sectional bottom view of a portion of the header connector having the ground shield of FIG. 4.

FIG. 5 is a cross-sectional bottom view of a portion of the mezzanine header connector 102 having the ground shield 130 shown in FIG. 4. The ground shield 130 has a center wall 158 and two side walls 160 like the ground shield 130 shown in FIG. 3. The ground shield 130 extends between a front end 176 and a rear end 178. The front end 176 is configured to mechanically engage and electrically connect to a receptacle ground shield (not shown) of the mezzanine receptacle connector 104 (shown in FIG. 1). Sections near the front end 176 may be plated for enhanced durability at mating interfaces that engage the receptacle connector 104. The rear portion 166 of the ground shield 130 that is received in the slot 164 of the housing 122 includes the rear end 178. The ground shield 130 defines an interior region 182 that is between the two side walls 160. In an exemplary embodiment, the ground shield 130 is stamped and formed from a panel of metal or another conductive material. For example, the side walls 160 are bent out of plane of the center wall 158 to define the side walls 160. In addition, the commoning feature 168 is integral with the corresponding side wall 160 from which the commoning feature extends. Thus, the commoning feature 168 is bent or otherwise formed out of the corresponding side wall 160.

In the illustrated embodiment, the commoning feature 168 is a spring arm 180. The spring arm 180 is cut and bent out of plane of the corresponding side wall 160. In the illustrated embodiment, both the left side wall 160A and the right side wall 160B include a spring arm 180. As shown in FIG. 5, the spring arm 180 on the right side wall 160B of a first ground shield 130A extends partially across the gap 170 between the first ground shield 130A and a second ground shield 130B to engage the spring arm 180 on the left side wall 160A of the second ground shield 130B. In an alternative embodiment, the spring arm 180 on the right side wall 160B of the first ground shield 130A extends fully across the gap 170 and engages the left side wall 160A of the second ground shield 130B. In the alternative embodiment, the left side wall 160A either does not have a spring arm 180 or the spring arm 180 of the left side wall 160A is at a different location along the side wall 160A such that the spring arm 180 does not engage the spring arm 180 of the right side wall 160B of the adjacent ground shield 130A.

In the illustrated embodiment, each spring arm 180 extends outward from the corresponding side wall 160. The spring arms 180 each extend outward to an end 184 having an engagement surface 186. The spring arm 180 is configured to physically contact the adjacent ground shield at the engagement surface 186. The end 184 of each spring arm 180 is resiliently deflectable along an arc 188 in a direction 190 from the natural resting position of the spring arm 180 shown in FIG. 4. The resilience of the spring arm 180 (i.e., the bias of the end 184 of the spring arm 180 to the natural resting position thereof) generates an engagement force between the engagement surface 186 and the adjacent ground shield 130 within the same row 140 to provide a reliable engagement and thus electrical connection between the two ground shields 130.

Figure 6:
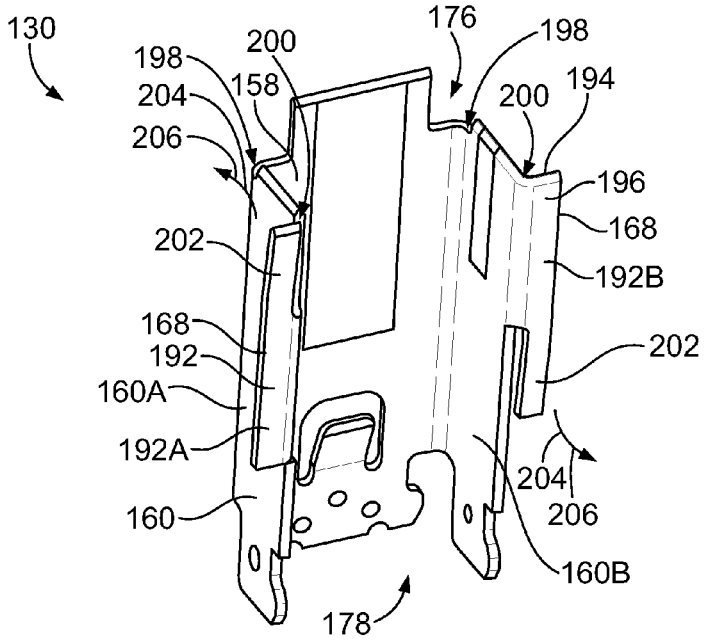
FIG. 6 is a perspective view of a ground shield of the header connector according to another embodiment.
Figure 7:
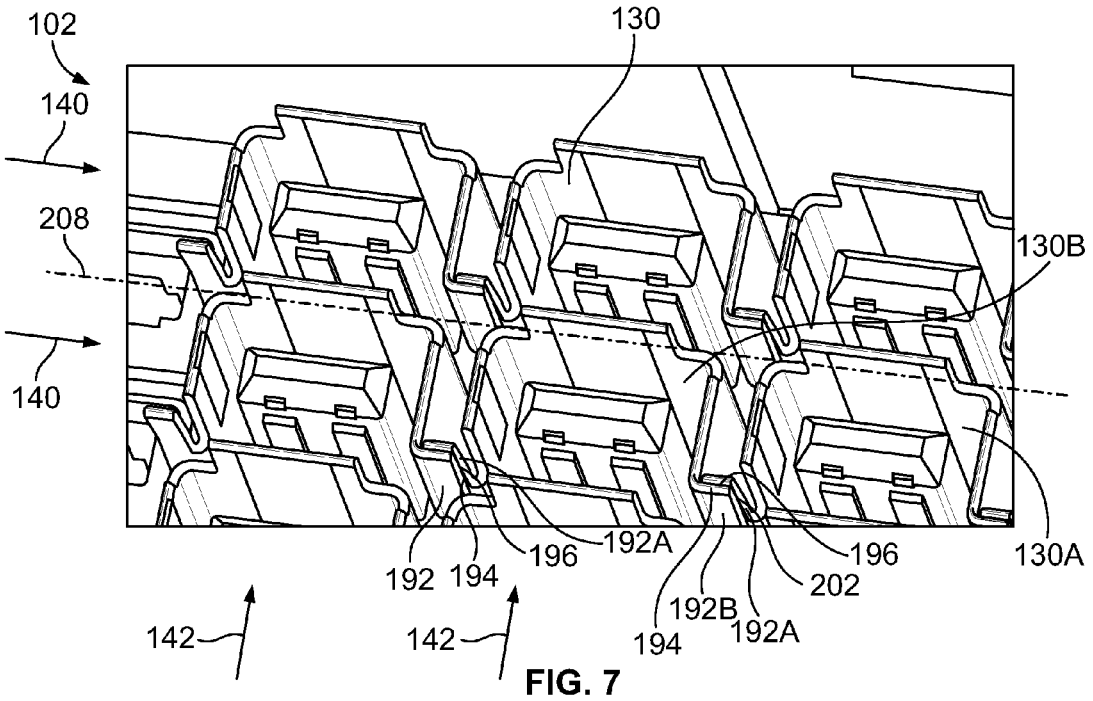
FIG. 7 is a perspective front view of a portion of the header connector having the ground shield of FIG. 6.

FIG. 6 is a perspective view of a ground shield 130 of the mezzanine header connector 102 (shown in FIG. 1) according to another embodiment. FIG. 7 is a perspective front view of a portion of the mezzanine header connector 102 having the ground shield 130 shown in FIG. 6. The ground shield 130 has a center wall 158 and two side walls 160 like the ground shield 130 shown in FIG. 3. In the illustrated embodiment, both the left side wall 160A and the right side wall 160B include the commoning feature 168. The commoning features 168 are each a ledge 192 that extends outward from the respective side wall 160A, 160B. Optionally, the ledge 192 extends perpendicular to the plane of the corresponding side wall 160. The ledge 192 may extend parallel to the center wall 158. The ledge 192 includes two opposite sides, referred to as a top side 194 and a bottom side 196. The ledge 192 extending from the left side wall 160A is referred to as a left ledge 192A, and the ledge 192 extending from the right side wall 160B is referred to as a right ledge 192B. The right ledge 192B of the ground shield 130 shown in FIG. 6 is configured to engage a left ledge 192A of an adjacent ground shield 130 to the right, and the left ledge 192A of the ground shield 130 is configured to engage a right ledge 192B of a different adjacent ground shield 130 to the left. As shown in FIG. 7, the bottom side 196 of the left ledge 192A abuts against the top side 194 of the adjacent ledge 192 to the left of the ground shield 130, and the top side 194 of the right ledge 192B abuts against the bottom side 196 of the adjacent left ledge 192A to the right. Alternatively, the side of each ledge 192 that engages the adjacent ledge 192 may be switched from the embodiment shown in FIG. 7.

As shown in FIG. 6, the side walls 160 of the ground shield 130 each have a proximal end 198 and a distal end 200. The proximal end 198 is at the center wall 158, while the distal end 200 is located away from the center wall 158. Optionally, the ledge 192 extends outward from the distal end 200 of the corresponding side wall 160. For example, the ledge 192 may be bent out of plane of the side wall 160 at the distal end 200 in a direction towards an adjacent ledge 192 of an adjacent ground shield 130. In other embodiments, the ledge 192 extends from the proximal end 198 or from a location between the proximal and distal ends 198, 200.

The ledge 192 of the ground shield 130 applies a biasing force on the adjacent ledge 192 to retain the mechanical engagement between the ground shields 130. Optionally, the ledge 192 includes a spring arm 202 that is bent out of plane of the ledge 192 towards the adjacent ledge 192. The spring arm 202 deflects along a plane parallel to the side wall 160. For example, the spring arm 202 is resiliently deflectable along an arc 204 in a direction 206 from the natural resting position of the spring arm 202 shown in FIG. 6. The resilience of the spring arm 202 generates a biasing or engagement force between the ledge 192 and the adjacent ledge 192. In the illustrated embodiment, both the left ledge 192A and the right ledge 192B of the ground shield 130 include a spring arm 202. Optionally, the spring arm 202 of the left ledge 192A is proximate to the front end 176 of the ground shield 130, while the spring arm 202 of the right ledge 192B is proximate to the rear end 178 of the ground shield 130, so the spring arms 202 do not directly engage spring arms 202 of adjacent ground shields 130. Rather, and as shown in FIG. 7, the spring arm 202 of the left ledge 192A of a first ground shield 130A in the group engages a planar surface of the right ledge 192B of a second ground shield 130B in the group.

In an embodiment, the groups of ground shields 130 that are mechanically engaged and electrically commoned are each ground shields 130 in the same row 140. The rows 140 extend parallel to a lateral axis 208. The columns 142 extend perpendicular to the rows 140. In an embodiment, the biasing forces between the ledges 192 (for example, the left ledge 192A of the first ground shield 130A and the right ledge 192B of the adjacent second ground shield 130B) are oriented in a direction parallel to the columns 142. Thus, in the embodiment shown in FIGS. 6 and 7, lateral biasing forces across the rows 140 are avoided.

FIGS. 8-13 show multiple embodiments of the ground shield 130 of the mezzanine header connector 102 (shown in FIG. 1) in which the commoning feature 168 at least partially defines a slot 210. The slot 210 is configured to receive a side wall 160 of an adjacent ground shield 130 or a tab extending from the side wall 160 of the adjacent ground shield 130. The side wall 160 or the tab is held within the slot 210 by an interference fit to retain mechanical engagement between the contacting ground shields 130 and, therefore, electrically common the ground shields 130 together.

Figure 8:
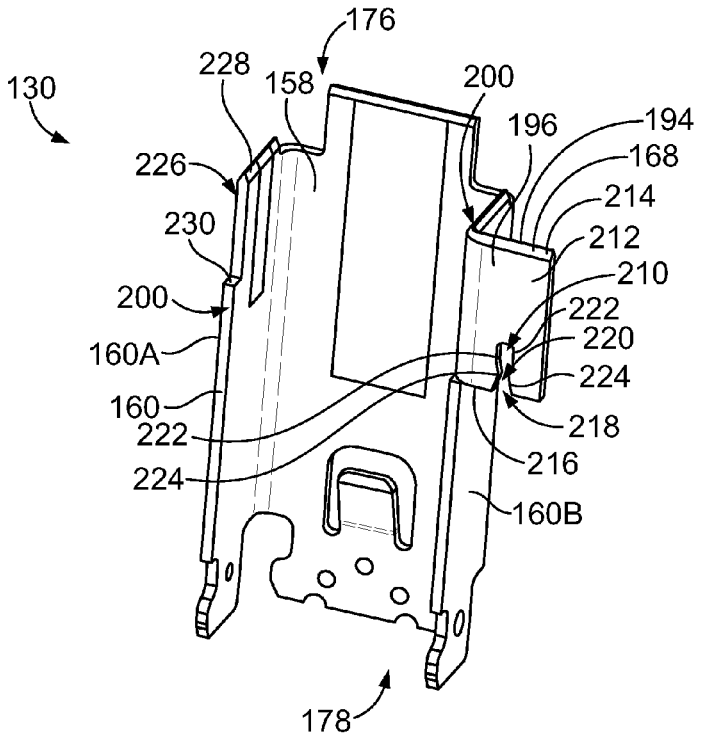
FIG. 8 is a perspective view of a ground shield of the header connector according to another embodiment.
Figure 9:
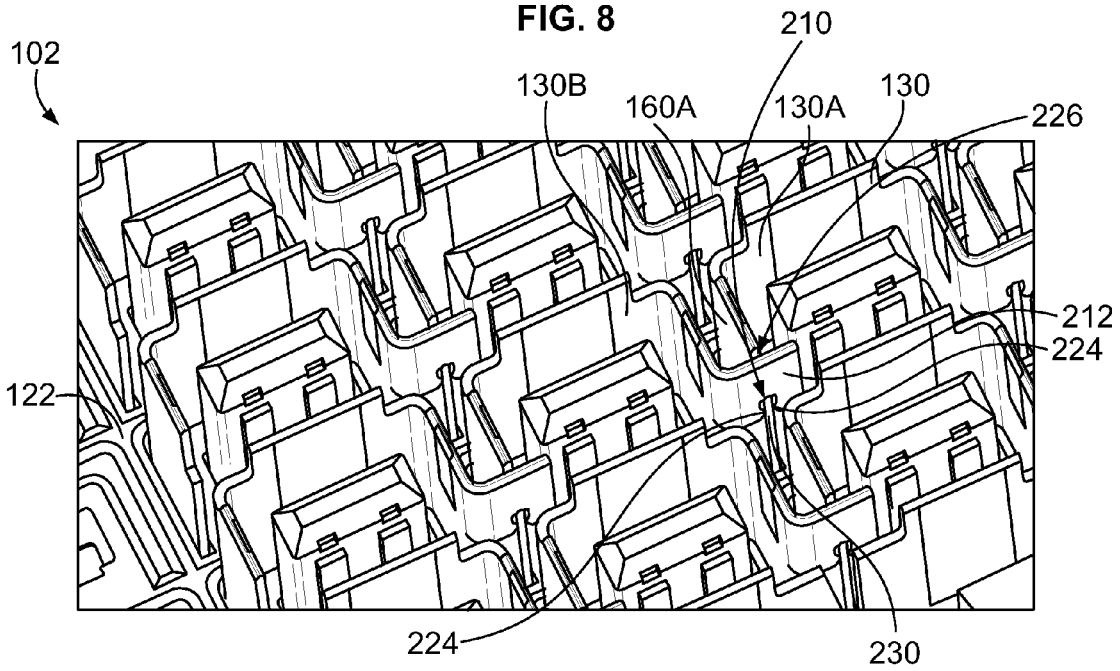
FIG. 9 is a perspective front view of a portion of the header connector having the ground shield of FIG. 8.

FIG. 8 is a perspective view of a ground shield 130 of the mezzanine header connector 102 (shown in FIG. 1) according to another embodiment. FIG. 9 is a perspective front view of a portion of the mezzanine header connector 102 having the ground shield 130 shown in FIG. 8. The ground shield 130 has a center wall 158 and two side walls 160 like the ground shield 130 shown in FIG. 3. The commoning feature 168 is a ledge 212 that extends outward from the distal end 200 of the respective side wall 160, like the ledges 192 shown in FIG. 6. In addition, the ledge 212 also has a first or top side 194 and a second or bottom side 196. However, the ground shield 130 in FIGS. 8 and 9 only includes one ledge 212, which optionally extends from the right side wall 160B. The left side wall 160A does not include a ledge. The ledge 212 includes a front edge 214 proximate to the front end 176 of the ground shield 130 and a rear edge 216 between the front edge 214 and the rear end 178 of the ground shield 130.

The ledge 212 defines the slot 210 which extends fully through the ledge 212 between the top side 194 and the bottom side 196 (such that the slot 210 is open at both sides 194, 196). The slot 210 includes a reception portion 218 and a retention portion 220 that is narrower than the reception portion 218. The slot 210 initially receives the side wall 160 or a tab extending from the side wall 160 of an adjacent ground shield 130 within the reception portion 218, and the side wall 160 or tab is retained in the slot 210 along the retention portion 220. Optionally, edges 222 of the slot 210 may define protrusions 224 that extend into the slot 210 at the retention portion 220. The protrusions 224 narrow the slot 210 and are configured to engage both sides of the side wall 160 or tab received within the slot 210 to provide an interference fit. Optionally, the reception portion 218 is defined along the rear edge 216 of the ledge 212, and the retention portion 220 is frontward of the reception portion 218. Thus, as the ground shield 130 is moved rearward into the cavity 132 (shown in FIG. 2) of the housing 122 to load the ground shield 130 in the housing 122, the slot 210 receives either the side wall 160 or the tab of an adjacent ground shield 130 that is already loaded in the housing 122. In an alternative embodiment, the reception portion 218 is defined along the front edge 214, and the slot 210 receives the side wall 160 or the tab of an adjacent ground shield 130 as the adjacent ground shield 130 is being loaded into the housing 122.

In the illustrated embodiment, the left side wall 160A defines a cut-out or notch portion 226 at the distal end 200 of the side wall 160A. The notch portion 226 extends to a front edge 228 of the side wall 160A. A step 230 defines a rear end of the notch portion 226. In an exemplary embodiment, the notch portion 226 is configured to accommodate the ledge 212 of an adjacent ground shield 130 as the adjacent ground shield 130 is being loaded into the housing 122. As shown in FIG. 9, as an adjacent second ground shield 130B moves further rearward into the housing 122, the slot 210 of the ledge 212 moves over the step 230 of the left side wall 160A of a first ground shield 130A that is already loaded into the housing 122. The protrusions 224 of the slot 210 engage both sides of the step 230 of the left side wall 160A to electrically common the first and second ground shields 130A, 130B together. In other embodiments, the left side wall 160A may define a tab extending outward from the side wall 160A that is configured to be received in the slot 210 of an adjacent ground shield 130, such as in the embodiments shown below.

Figure 10:
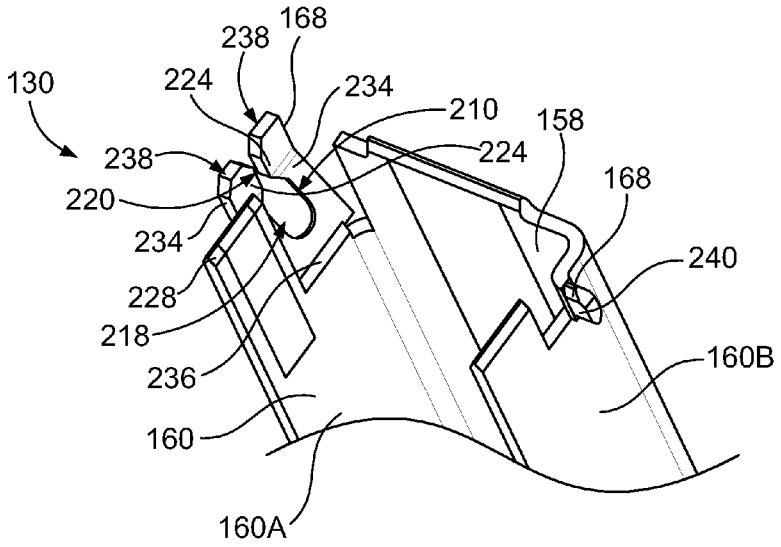
FIG. 10 is a perspective view of a portion of a ground shield of the header connector according to another embodiment.
Figure 11:
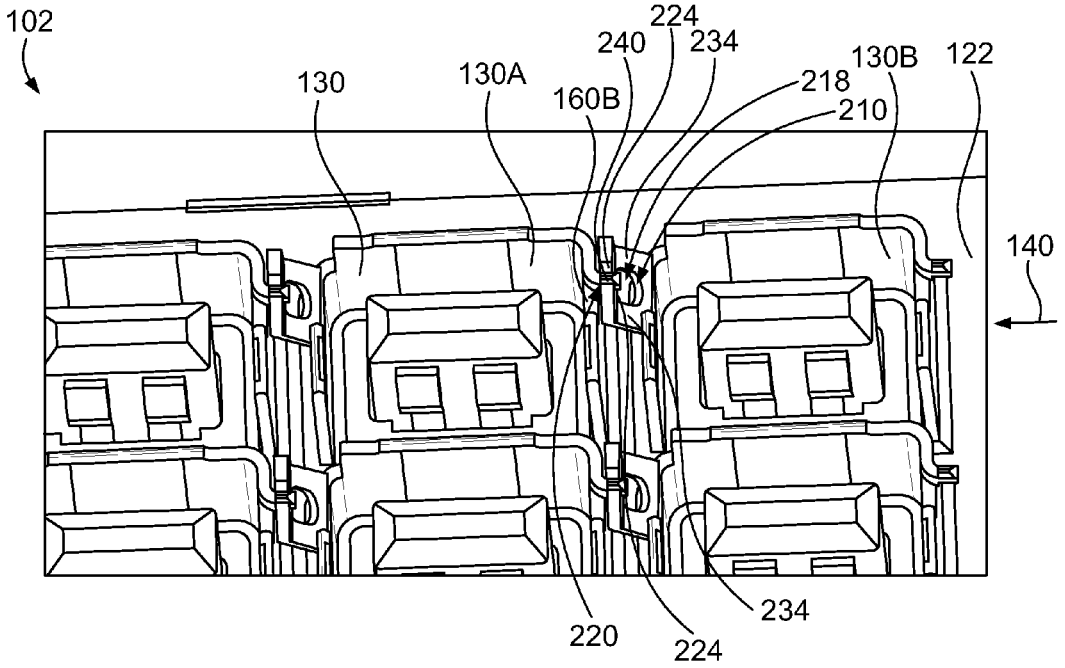
FIG. 11 is a perspective front view of a portion of the header connector having the ground shield of FIG. 10.

FIG. 10 is a perspective view of a portion of a ground shield 130 of the mezzanine header connector 102 (shown in FIG. 1) according to another embodiment. FIG. 11 is a perspective front view of a portion of the mezzanine header connector 102 having the ground shield 130 shown in FIG. 10. The ground shield 130 has a center wall 158 and two side walls 160 like the ground shield 130 shown in FIG. 3. In the illustrated embodiment, the left side wall 160A has a commoning feature 168 that is two parallel spring beams 234 that define the slot 210 therebetween. The spring beams 234 are bent outwards from a plane of the side wall 160A at a crease 236 that extends parallel to the front edge 228 of the side wall 160A. The slot 210 extends towards the crease 236 from distal ends 238 of the spring beams 234. Although the distal ends 238 of the two spring beams 234 are not integral with each other in the illustrated embodiment (thus forming two separate spring beams 234), in an alternative embodiment the slot 210 may be defined within a single spring beam. The reception portion 218 of the slot 210 is more proximate to the crease 236 than the retention portion 220, which is defined between a respective protrusion 224 on each of the spring beams 234. As a result, the slot 210 resembles a keyhole.

The right side wall 160B includes a tab 240 that extends outward from the side wall 160B. The tab 240 is configured to be received in the slot 210 and to engage the spring beams 234 of an adjacent ground shield 130 to electrically common the ground shields 130. Thus, the tab 240 is also a commoning feature 168. The tab 240 is a commoning feature 168 on the right side wall 160B that is complementary to the commoning feature 168—the spring beams 234—on the left side wall 160A. In another embodiment, the tab 240 extends from the left side wall 160A, and the spring beams 234 defining the slot 210 extend from the right side wall 160B. As shown in FIG. 11, a second ground shield 130B is located to the right of a first ground shield 130A in the same row 140. The second ground shield 130B is loaded into the housing 122 prior to the first ground shield 130A. As the first ground shield 130A is loaded into the housing 122 in the rearward direction, the tab 240 extending from the right side wall 160B of the first ground shield 130A is received in the keyhole reception portion 218 of the slot 210 of the second ground shield 130B. Further rearward movement of the first ground shield 130A relative to the second ground shield 130B causes the tab 240 to be received in the retention portion 220 of the slot 210 between the protrusions 224 of the spring beams 234, which retain the tab 240 by an interference fit.

Figure 12:
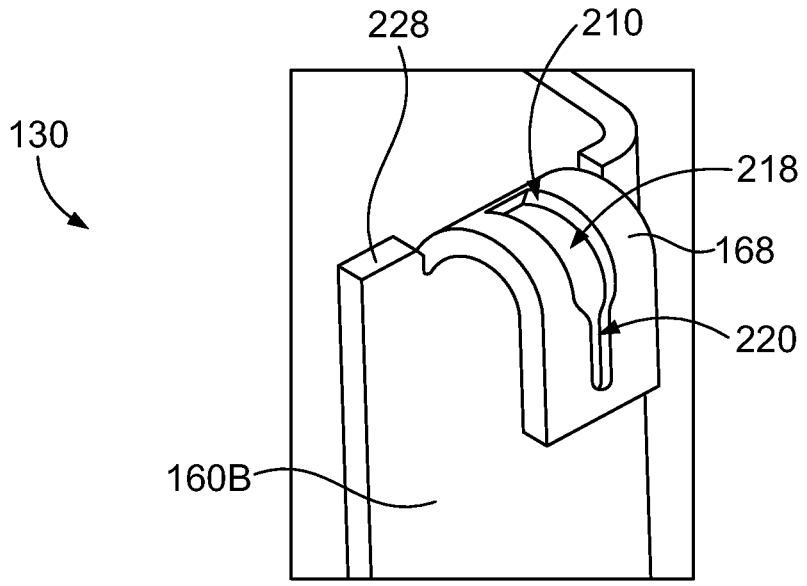
FIG. 12 is a perspective view of a portion of a ground shield of the header connector according to another embodiment.

FIG. 12 is a perspective view of a portion of a ground shield 130 of the mezzanine header connector 102 (shown in FIG. 1) according to another embodiment. FIG. 12 shows a commoning feature 168 extending from the right side wall 160B of the ground shield 130. The commoning feature 168 extends outward and rearward from a front edge 228 of the side wall 160B. Like the slot 210 shown in FIG. 10, the reception portion 218 of the slot 210 resembles a keyhole opening and is disposed more proximate to the front edge 228 of the side wall 160B than the retention portion 220, resembling a keyhole opening. The commoning feature 168 is configured to receive a tab extending from a left side wall 160A (shown in FIG. 4) of an adjacent ground shield 130. The tab may be the tab 240 shown in FIG. 10. For example, the ground shield 130 shown in FIG. 12 may be loaded into the housing 122 (shown in FIG. 2) prior to the adjacent ground shield 130. As the adjacent ground shield 130 is loaded, the tab of the adjacent ground shield 130 is received in the reception portion 218 and then in the retention portion 220 of the slot 210 to retain and electrically common the ground shields 130 together.

Figure 13:
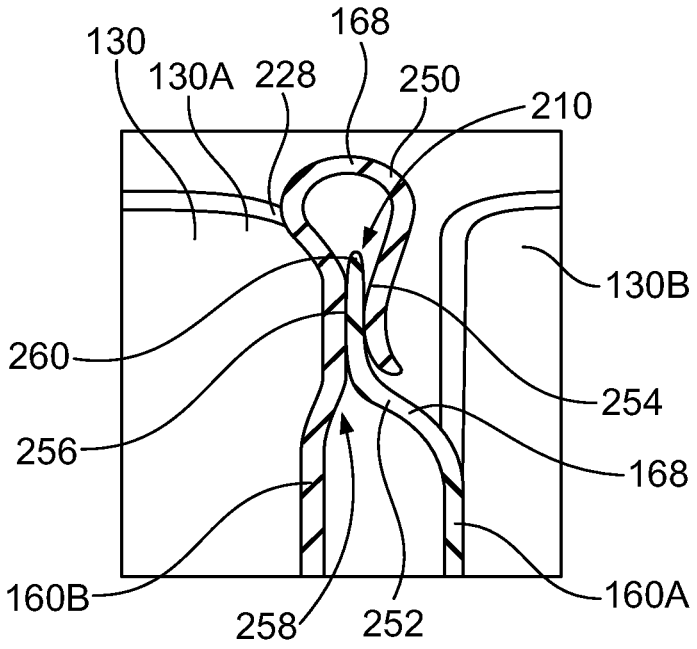
FIG. 13 is a cross-sectional view of a portion of two ground shields mechanically engaged to each other according to another embodiment.

FIG. 13 is a cross-sectional view of a portion of two ground shields 130 mechanically engaged to each other according to another embodiment. A left ground shield 130A includes a commoning feature 168 that is a clip 250, and a right ground shield 130B engaged to the left ground shield 130A includes a commoning feature 168 that is a tab 252. Like the commoning feature 168 shown in FIG. 12, the clip 250 extends outward and rearward from the front edge 228 of the right side wall 160B. However, unlike the commoning feature 168 shown in FIG. 12, the clip 250 does not define a slot 210 extending through the clip 250. Instead, the edges of the slot 210 are defined by an interior surface 254 of the clip 250 and an exterior surface 256 of the right side wall 160B. The clip 250 may resemble an R-clip or a hairpin cotter pin. Optionally, the right side wall 160B includes a jogged section 258 that is jogged outward from a planar surface of the side wall 160B, and the exterior surface 256 of the jogged section 258 defines an edge of the slot 210.

The tab 252 extends outward from the left side wall 160A of the right ground shield 130B. The tab 252 has an S-shaped curve. A distal end 260 of the tab 252 extends forward generally parallel to the left side wall 160A. The right ground shield 130B is loaded in the housing 122 (shown in FIG. 2) prior to the left ground shield 130A. As the left ground shield 130A is moved rearward to load the ground shield 130A in the housing 122, the distal end 260 of the tab 252 is received in the slot 210. For example, the slot 210 may have a width that is narrower than a thickness of the tab 252 such that the clip 250 is deflected outward and/or the jogged section 258 of the right side wall 160B is deflected inward relative to the left ground shield 130A as the tab 252 is received in the slot 210. The tab 252 is retained in the slot 210 between the clip 250 and the right side wall 160B to mechanically couple and electrically common the left and right ground shields 130A, 130B.

Although the embodiments described herein primarily describe the ground shields 130 (shown in FIG. 2) as being associated with the header connector 102 (shown in FIG. 1), it is recognized that the embodiments of the ground shields 130 may additionally or alternatively be used in association with the receptacle connector 104 (FIG. 1). In addition, the ground shields 130 and other components of the connectors described herein are not limited to use in mezzanine style connectors, although mezzanine connectors constitute one exemplary use of such components.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(1), unless and until such claim limitations expressly use the phrase "means for" followed by a statement of function void of further structure.

What is claimed is:

1. An electrical connector comprising:

a housing extending between a front end and an opposite, rear end, the housing defining a cavity at the front end;

signal contacts held by the housing, the signal contacts arranged in pairs carrying differential signals, the signal contacts having mating ends in the cavity for mating with a mating connector; and ground shields held by the housing, the ground shields extending along the signal contacts in the cavity, the ground shields having center walls and side walls surrounding associated pairs of the signal contacts on at least two sides thereof, the ground shields each having a commoning feature extending outward from a corresponding side wall, the commoning feature directly mechanically engaging another ground shield in a group of ground shields to electrically join the ground shields of the group within the cavity.

2. The electrical connector of claim 1, wherein the ground shields are arranged in an array of rows and columns, the group of ground shields comprising ground shields within a first row of the rows, the ground shields of the group being electrically joined via the commoning feature of each of the ground shields mechanically engaging an adjacent ground shield within the first row.

3. The electrical connector of claim 1, wherein the ground shields each include one center wall and two side walls, the two side walls extending from opposite ends of the center wall, the commoning feature extending from a right side wall of the two side walls, the commoning feature mechanically engaging a left side wall of the two side walls of another ground shield in the group.

4. The electrical connector of claim 1, wherein the commoning feature is a spring arm bent out of plane of the corresponding side wall, the spring arm deflecting at least partially towards the side wall upon mechanically engaging the other ground shield in the group and applying a biasing force on the other ground shield to retain mechanical engagement therewith.

5. The electrical connector of claim 1, wherein the commoning feature is a convexity that protrudes outwards from the corresponding side wall, the convexity deflecting at least partially inwards upon mechanically engaging the other ground shield in the group and applying a biasing force on the other ground shield to retain mechanical engagement therewith.

6. The electrical connector of claim 1, wherein the ground shields each include one center wall and two side walls, the two side walls extending from opposite ends of the center wall, the two side walls each having a proximal end at the center wall and a distal end away from the center wall, the commoning feature being a right ledge extending outward from the distal end of a right side wall of the two side walls, each ground shield further including a left ledge extending outward from the distal end of a left side wall of the two side walls, the right ledge of a first ground shield in the group mechanically engaging the left ledge of a second ground shield in the group.

7. The electrical connector of claim 6, wherein the right ledge extending from the right side wall of the first ground shield includes a spring arm configured to deflect along a plane parallel to the right side wall, the spring arm mechanically engaging and applying a biasing force on at least one of the left ledge of the second ground shield or a spring arm of the left ledge of the second ground shield.

8. The electrical connector of claim 6, wherein the ground shields are arranged in an array of rows and columns, the first ground shield and the second ground shield being disposed adjacent to each other in a first row of the rows, biasing forces between the right ledge of the first ground shield and the left ledge of the second ground shield directed parallel to the columns.

9. The electrical connector of claim 1, wherein the commoning feature is integral with the corresponding side wall from which the commoning feature extends.

10. The electrical connector of claim 1, wherein the ground shields each include one center wall and two side walls, the two side walls extending from opposite ends of the center wall, the commoning feature being a right commoning feature that extends from a right side wall of the two side walls, the ground shields each further including a left commoning feature that extends from a left side wall of the two side walls, the right and left commoning features of a same ground shield mechanically engaging two different ground shields of the group.

11. The electrical connector of claim 10, wherein the left commoning feature is identical to the right commoning feature.

12. The electrical connector of claim 10, wherein the left commoning feature is complementary to the right commoning feature, the right commoning feature of a first ground shield of the group mechanically engaging the left commoning feature of a second ground shield of the group, the left commoning feature of the first ground shield mechanically engaging the right commoning feature of a third ground shield of the group, the first ground shield disposed between the second ground shield and the third ground shield.

13. The electrical connector of claim 1, wherein the commoning feature of a first ground shield at least partially defines a slot, the slot receiving a side wall of a second ground shield in the group or a tab extending from the side wall of the second ground shield, the side wall or the tab being held between edges of the slot by an interference fit to retain mechanical engagement between and electrically join the first and second ground shields.

14. The electrical connector of claim 13, wherein the slot extends through the commoning feature between top and bottom sides of the commoning feature, the slot including a reception portion and a retention portion that is narrower than the reception portion, the slot configured to receive the side wall or the tab of the second ground shield in the reception portion and configured to retain said side wall or said tab in the retention portion.

15. The electrical connector of claim 14, wherein the commoning feature extends outward and rearward from a front edge of the corresponding side wall.

16. The electrical connector of claim 14, wherein the commoning feature extends outward from a distal end of the corresponding side wall, the reception portion of the slot being defined along a rear edge of the commoning feature, the retention portion disposed frontward of the reception portion, the slot configured to receive the side wall or the tab of the second ground shield as the first ground shield is moved rearward into the cavity of the housing.

17. The electrical connector of claim 13, wherein the commoning feature extends outward and rearward from a front edge of the corresponding side wall, an interior surface of the commoning feature and an exterior surface of the corresponding side wall defining the edges of the slot, the tab of the second ground shield having a distal end extending frontward, the slot configured to receive the distal end of the tab of the second ground shield as the first ground shield is moved rearward into the cavity of the housing.

18. An electrical connector comprising:

a housing extending between a front end and an opposite, rear end, the housing defining a cavity at the front end;

signal contacts held by the housing, the signal contacts having mating ends in the cavity for mating with a mating connector, the signal contacts arranged in pairs, and ground shields held by the housing, the ground shields extending along the signal contacts in the cavity and arranged in an array of rows and columns, the ground shields each having one center wall and two side walls, the side walls extending from opposing ends of the center wall, each ground shield surrounding a corresponding pair of signal contacts on at least three sides thereof such that both signal contacts in the pair are located between the two side walls and on a same side of the center wall, at least one of the side walls of each ground shield having a commoning feature extending outward from the respective side wall, wherein the commoning feature of a first ground shield of the ground shields mechanically engages a second ground shield of the ground shields such that the first and second ground shields are electrically joined with each other, the first and second ground shields being within a first row of the rows.

19. The electrical connector of claim 18, wherein the side walls are a left side wall and a right side wall and both of the side walls have the commoning feature, each commoning feature being a ledge that extends outward from the respective side wall, each ledge having a top side and a bottom side, the top side of the ledge extending from the right side wall of the first ground shield mechanically engaging the bottom side of the ledge extending from the left side wall of the second ground shield, biasing forces between the ledges directed parallel to the columns.

20. The electrical connector of claim 18, wherein the commoning feature of the first ground shield at least partially defines a slot, the slot receiving one of the side walls of the second ground shield or a tab extending from one of the side walls of the second ground shield, the side wall or the tab received in the slot being held between edges of the slot by an interference fit to retain mechanical engagement between and electrically join the first and second ground shields.

* * * * *